US006916299B2

(12) United States Patent
Fang

(10) Patent No.: US 6,916,299 B2
(45) Date of Patent: Jul. 12, 2005

(54) MASSAGE DEVICE HAVING A POWER CORD WITH USB PLUG

(75) Inventor: Chien-Fa Fang, Taipei (TW)

(73) Assignee: I.E. Turbo Enterprise Co., Ltd., Taipei (TW)

( * ) Notice: Subject to any disclaimer, the term of this patent is extended or adjusted under 35 U.S.C. 154(b) by 209 days.

(21) Appl. No.: 10/338,467

(22) Filed: Jan. 9, 2003

(65) Prior Publication Data

US 2004/0138595 A1 Jul. 15, 2004

(51) Int. Cl.[7] ..... A61H 23/02; A61H 1/00
(52) U.S. Cl. ..... 601/70; 601/46; 601/67
(58) Field of Search ..... 601/27, 28, 30, 601/46, 49, 52, 56–58, 67, 68, 69, 70, 72, 74, 131, 134

(56) References Cited

U.S. PATENT DOCUMENTS 5,413,551 A * 5/1995 Wu ..... 601/46
5,792,025 A * 8/1998 Kikinis ..... 482/1
5,857,986 A * 1/1999 Moriyasu ..... 601/49
6,011,486 A * 1/2000 Casey ..... 340/7.29
6,432,071 B1 * 8/2002 Hsieh ..... 601/72
6,599,259 B2 * 7/2003 Muir ..... 601/46
2002/0014960 A1 * 2/2002 Williams, Jr. ..... 340/500

* cited by examiner

*Primary Examiner*—Danton D. DeMille
*Assistant Examiner*—Quang D. Thanh

(57) ABSTRACT

A massage device comprising a vibrator and a power cord wherein the first end of the power cord is connected to the vibrator and the second thereof is connected to a USB plug, and the USB plug is capable of inserting into a USB interface of a computer and then the direct current of the computer is able to provide power source to the vibrator so as to use the computer and the massage device at the same time.

1 Claim, 3 Drawing Sheets

MASSAGE DEVICE HAVING A POWER CORD WITH USB PLUG

BACKGROUND OF THE INVENTION

1. Field of the Invention

This invention relates generally to a massage device, and more particularly to a massage device which is compatible to a USB (Universal Serial Bus) interface of a computer and is able to insert into a USB socket thereof.

2. Description of the Prior Art

As computers are now in widespread use, people from all trades and professions use computers everyday. However, if users keep the same postures from sitting in front of the computers all the time, they will not only feel fatigued easily, but also their bloods will run in the bad circulation. Therefore, a massage device for recovering strength and circulating blood round the body is used to relaxed body and mind.

When a computer is in use, it is necessary to supply the power source to a host, a screen and other peripheral devices, and therefore an extended line with several sockets are required so as to insert the plugs thereof and then achieve the power source. However, the number of the sockets of the extended line is restricted and is insufficient for the needs. Besides, if a lot of plugs are inserted into the sockets of the extended line, the load of the electric current will be exceeded and resulted in danger of blowing the fuse or even catching a fire.

Moreover, when people go out and carry notebook computers, since no sockets are available, the massage device is unable to use. Especially to people go abroad, because of different voltage system, they will fail to use the massage device and will be tired from running around.

It is therefore tried by the inventor to develop a massage device, especially a massage device compatible to a USB (Universal Serial Bus) interface of a computer and able to insert into a USB socket thereof for saving the above-mentioned persecutions and drawbacks.

OBJECTIVES AND ADVANTAGES OF THE INVENTION

Accordingly, it is a primary objective of the present invention claimed herein to provide a massage device, which is provided with a USB plug and is capable of using with a computer simultaneously.

SUMMARY OF THE INVENTION

For reaching above objective and other objectives, the present invention is provided a massage device comprising a vibrator and a power cord. The first end of the power cord is connected to the vibrator and the second thereof is connected to a USB plug. The USB plug is capable of inserting into a USB interface of a computer and then the direct current of the computer is able to provide power source to the vibrator so as to use the computer and the massage device at the same time.

The vibrator comprises an eccentric motor disposed between an upper cover and a lower cover. A switch is provided between the upper cover and the lower cover so as to switch the eccentric motor on and off. The first end of the power cord is first connected to the switch and then is attached to the eccentric motor.

The USB plug is connected to the second end of the power cord and is compatible to the USB interface of the computer so as to insert into a USB socket thereof. Therefore, the power source is conducted through the USB interface and is provided to the vibrator so as to make the massage device vibrated and thus take user's fatigue away.

Since the power source conducted from the computer is employed the circuit of the computer with suitable management, the power is thus supplied from the second end of the power cord to the first end of the power cord via the USB interface by the USB plug. When a user presses the switch, the eccentric motor is then driven by electricity so as to produce a massage effect to the vibrator and the massage device can thus be used together with the computer.

After all elements are assembled, the user may insert the USB plug into a USB interface of any computer. Then, the power is supplied to the vibrator so as to massage the user's body at his/her own will.

By virtue of this arrangement, a massage device capable of using together with a computer is provided to save the drawbacks of the prior art, thereby the user aching all over with fatigue because of setting before a computer all the time is able to massage his/her body by a vibrator of the massage device. In the meantime, since the computer is provided with good control and management of circuit itself without increasing the cost, the massage device of the present invention is able to employ in everywhere and the user may relax his/her body so as to recover strength and circulate blood.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
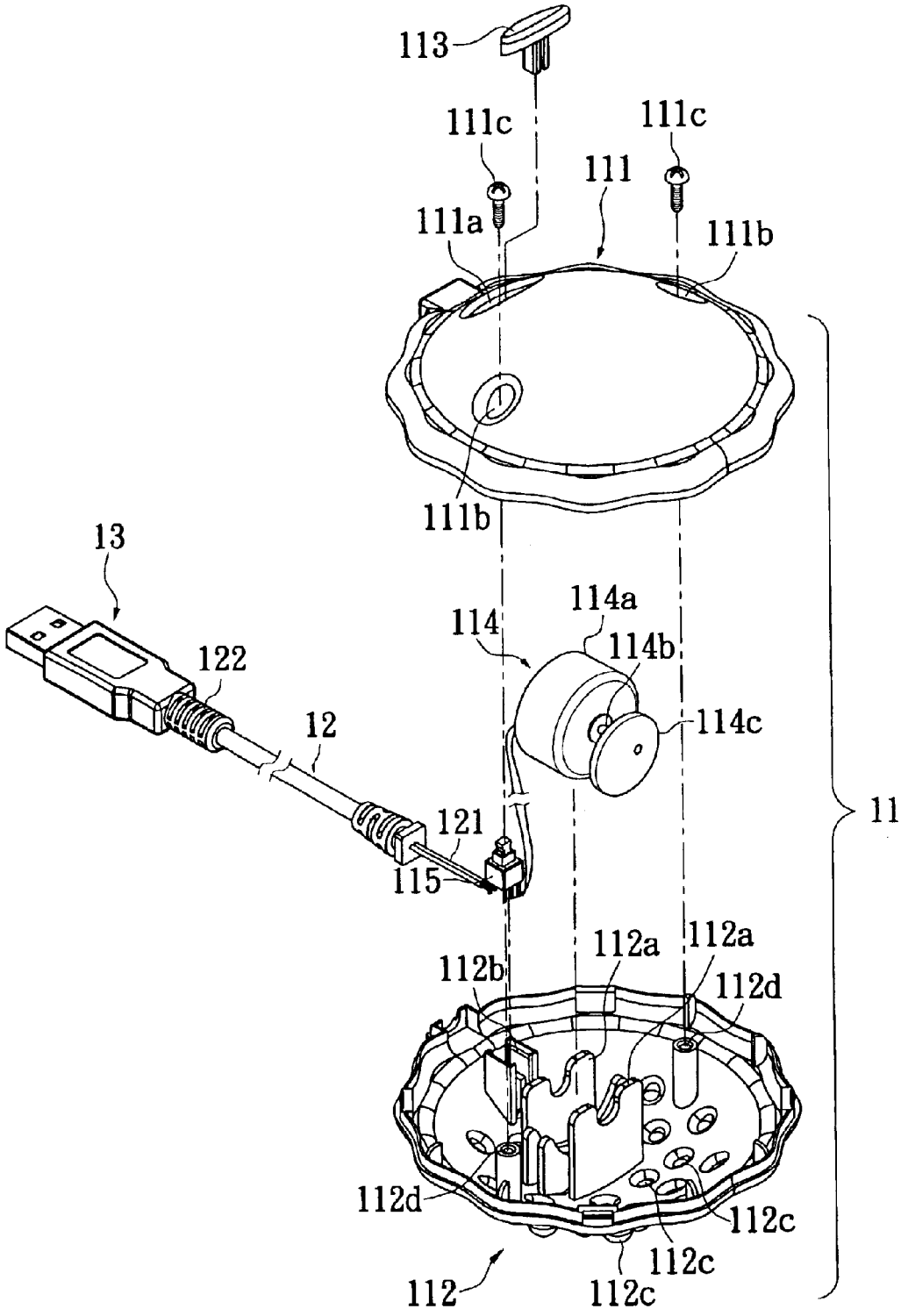
FIG. 1 is an exploded view illustrating a massage device according to the present invention.
Figure 2:
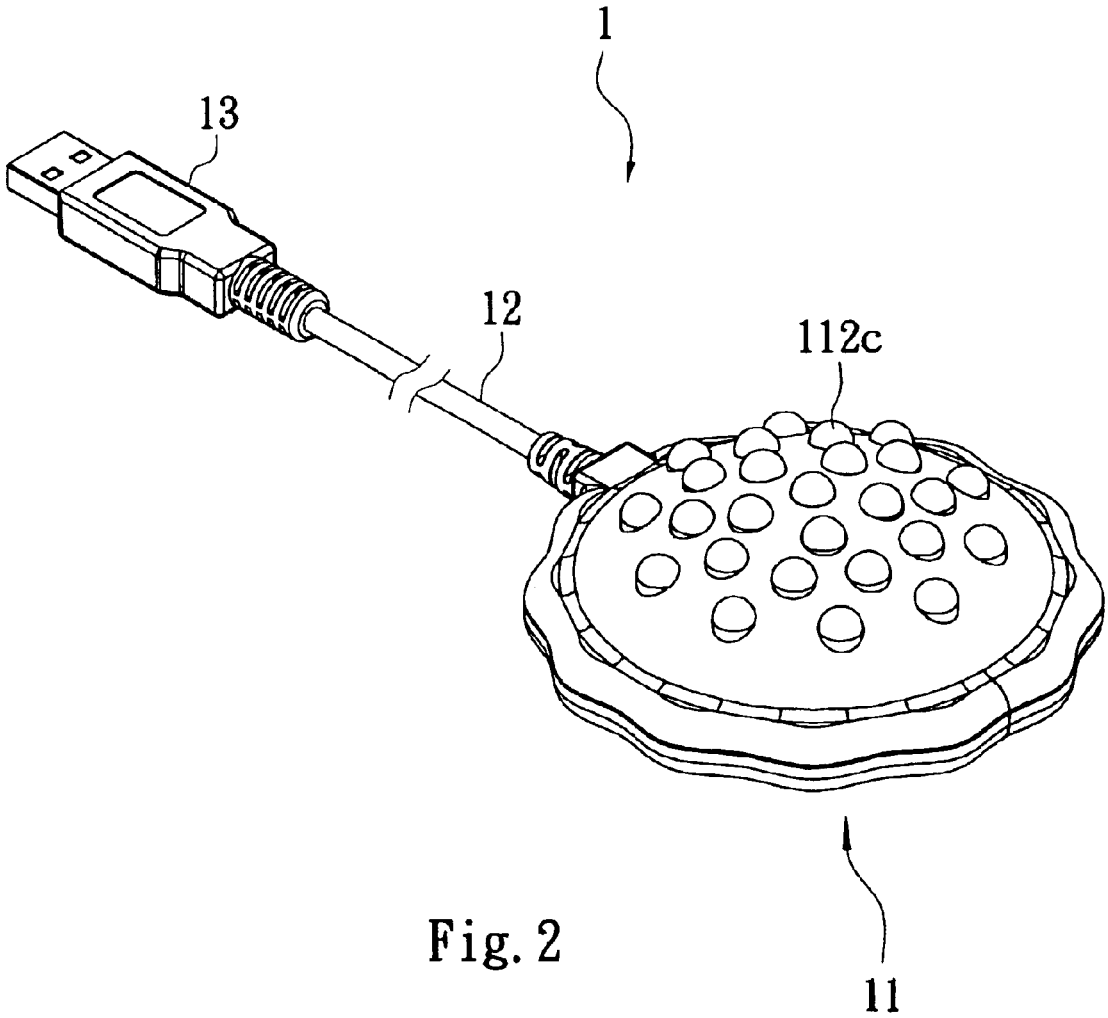
FIG. 2 is a front view illustrating the structure of the massage device according to the present invention.

As shown in FIG. 1 and FIG. 2, a massage device 1 according to the present invention is comprised of a vibrator 11, a power cord 12 and a USB plug 13. The vibrator 11 is comprised of an upper cover 111, a lower cover 112 and an eccentric motor 114. The upper cover 111 has an opening and the lower cover 112 is formed with a plurality of massage units 112*c*, such as protrusions or knobs. The vibrator 11 is further disposed with a button 113, an eccentric motor 114, and a switch 115, wherein the button 113, the eccentric motor 114 and the switch 115 are disposed among an accommodation space by assembling the upper cover 111 and the lower cover 112. The upper cover 111 and the lower cover 112 are assembled by fastening through holes 111*b*, screw bolts 112*d* and screws 111*c* cooperatively.

The button 113 is provided in the opening 111*a* of the upper cover 111 in a manner that the button 113 is only able to push from the opening 111*a* of the upper cover 111 and is unable to separate from the opening 111*a* after releasing the button 113. The eccentric motor 114 is fixed to a first secure unit 112*a* of the lower cover 112. The switch 115 is fixed to a second secure unit 112*b* of the lower cover 112. The button 113, the eccentric motor 114, and the switch 11 are provided between the accommodation space of the upper cover 111 and the lower cover 112. A first end 121 of the power cord 12 is connected to the switch 115 in advance and then is attached to the eccentric motor 114. The button 113 is pressed to the switch 115 correspondingly.

A second end 122 of the power cord 12 is connected to the USB plug 13, wherein the USB plug 13 is compatible to a USB (e.g. a USB port) interface of a computer (not shown) and is able to insert thereinto. The power source of the computer is then provided to the vibrator so as to use the computer and the massage device at the same time.

Since the eccentric action of an eccentric motor and the USB interface of a computer are both well known, the superfluous description are omitted herein.

Figure 3:
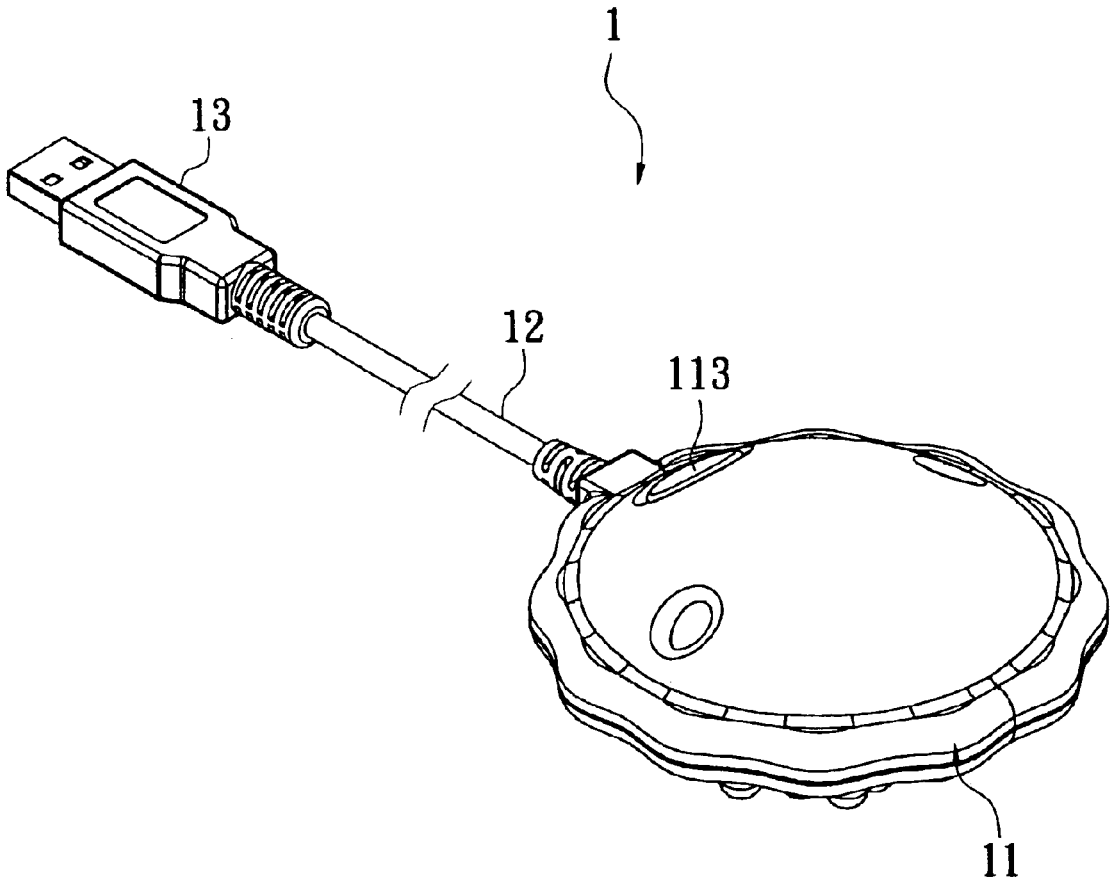
FIG. 3 is a back view illustrating the structure of the massage device according to the present invention.

As shown in FIG. 2 and FIG. 3, after all elements are assembled, the user may insert the USB plug 13 into the USB interface of the computer. Then, the power is supplied to the vibrator 11 so as to massage the user's body at his/her own will.

By virtue of the above-mentioned arrangement, users may insert the USB plug 13 of the massage device 1 into the USB interface of the computer and the computer can provide its power source from the second end 122 of the power cord 12 to the first end 121. When the switch 115 is pressed by pushing the button 113, the eccentric motor 114 is then driven by electricity so as to produce a massage effect to the vibrator 11 and thereby users may massage their bodies by the massage units 112*c* of the vibrator 11.

Further, since the computer is provided with good control and management of circuit, there is not necessary to buy or design some specific circuits for transforming the power source. Thus, the cost for purchasing specific circuits is unnecessary and a good protect of the circuits is achieved.

Moreover, a display unit (not shown) is further provided to the vibrator 11 for showing the operational state, i.e. when the display unit is shining, it shows the operational mode of the massage device 1, and when the display unit is not shining, it shows the non-operational mode of the massage device 1. In addition, the button 113 is employed for the massage device 1 of the present invention. It is to be understood that the button 11 can be omitted or replaced by other equivalent elements.

Furthermore, the massage device 1 comprises the upper cover 111 and the lower cover 112 both in substantially round-shaped for assembling the vibrator 11. However, the vibrator 11 may be accommodated to other covers or equivalent elements in any shape or form. Also, the massage units 112*c* can be provided not only the lower cover 112 but also the other positions of the massage device 1 and the shape or the number of the massage units 112*c* can be changed depend on the demand or the design.

In comparison with the existing technology, the massage device of the present invention is characterized in that the massage device is compatible to a USB interface of a computer and is able to insert into a USB socket thereof. Therefore, the massage device of the present invention is capable of using together with any computer including a notebook computer and users can enjoy the convenience and relax in everywhere so as to recover strength and circulate blood.

By virtue of this arrangement, a massage device capable of using together with a computer is thus provided to save the drawbacks of the prior art. When the massage device according to the present invention is connected to the USB interface of the computer, the massage device may be electrically connected therein and the security in use may be protected simultaneously.

It is not intended, however, that the invention is limited to the particular embodiments described or to use in connection with the apparatus illustrated herein. Various modifications and alternative embodiments such as would ordinarily occur to one skilled in the art to which the invention relates are also contemplated and included within the meaning and range of equivalents of the appended claims.

What is claimed:

1. A massage device comprising;

a vibrator with an eccentric motor disposed between an upper cover and a lower cover, the vibrator being formed with a plurality of massage units;

a power cord including a first end connected to the vibrator and a second end connected to a universal serial bus (USB) plug, wherein the USB plug is capable of inserting into a USB interface of a computer and then the direct current of the computer is able to provide power source to the vibrator so as to use the computer and the massage device at the same time; and a switch provided between the upper cover and the lower cover to switch the eccentric motor on and off, a button being provided on the upper cover for controlling the switch, the lower cover being formed with a plurality of massage units, the massage units being protrusions.

* * * * *